US006153232A

United States Patent [19]

Holten et al.

[11] Patent Number: 6,153,232

[45] Date of Patent: Nov. 28, 2000

[54] BOIL-IN-BAG PACKAGE

[75] Inventors: Steven Holten, Houston, Tex.; Balbir Singh, Media, Pa.; David A. Blythe, Philadelphia, Pa.; Simon R. Gainey, Bryn Mawr, Pa.; Edward J. O'Brien, East Hampton, N.J.

[73] Assignee: Uncle Ben's, Inc., Houston, Tex.

[21] Appl. No.: 09/248,865

[22] Filed: Feb. 11, 1999

[51] Int. Cl.[7] ..... B65D 81/34

[52] U.S. Cl. ..... 426/79; 426/82; 426/113; 426/123; 53/329; 206/5; 383/97; 383/207; 383/209

[58] Field of Search ..... 426/79, 82, 123, 426/113; 53/329; 206/5; 383/10, 97, 207, 209

[56] References Cited

U.S. PATENT DOCUMENTS

| | | | |
|---|---|---|---|
| 2,145,941 | 2/1939 | Maxfield . | |
| 3,081,174 | 3/1963 | Gay | 99/171 |
| 3,114,643 | 12/1963 | Boston et al. | 426/113 |
| 3,199,437 | 8/1965 | Nelsen | 426/113 |
| 3,407,077 | 10/1968 | Helin | 426/113 |
| 3,615,712 | 10/1971 | Keller | 99/171 H |
| 3,819,089 | 6/1974 | Scales | 222/95 |
| 3,830,944 | 8/1974 | Dimitriadis et al. | 426/113 |
| 3,873,735 | 3/1975 | Chalin et al. | 426/87 |
| 3,895,118 | 7/1975 | Rambold | 426/83 |
| 4,290,521 | 9/1981 | Mitchell | 206/0.5 |
| 4,358,466 | 11/1982 | Stevenson | 426/106 |
| 4,514,426 | 4/1985 | Jordan et al. | 426/113 |
| 4,605,123 | 8/1986 | Goodrum et al. | 206/0.5 |
| 4,651,870 | 3/1987 | Giambalvo | 206/0.5 |
| 4,787,755 | 11/1988 | Branson | 383/65 |
| 4,796,300 | 1/1989 | Branson | 383/63 |
| 4,879,124 | 11/1989 | Oberle | 426/113 |
| 4,923,701 | 5/1990 | VanErden | 426/113 |
| 5,044,777 | 9/1991 | Watkins et al. | 383/100 |
| 5,222,813 | 6/1993 | Kopp et al. | 383/200 |
| 5,342,634 | 8/1994 | Murata et al. | 426/113 |
| 5,366,741 | 11/1994 | Van Der Zon | 426/79 |
| 5,419,437 | 5/1995 | Huseman | 206/554 |
| 5,552,165 | 9/1996 | Haak et al. | 426/80 |
| 5,827,559 | 10/1998 | Powell | 426/412 |
| 5,863,585 | 1/1999 | Sjöberg | 426/389 |
| 5,914,142 | 6/1999 | Zartner | 426/113 |

FOREIGN PATENT DOCUMENTS

| | | |
|---|---|---|
| 0478812A1 | 4/1992 | European Pat. Off. . |
| 0499647A1 | 8/1992 | European Pat. Off. . |
| 0561654A1 | 9/1993 | European Pat. Off. . |
| 7540166 | 4/1976 | Germany . |
| 4017363A1 | 12/1991 | Germany . |
| 19716141A1 | 10/1997 | Germany . |
| 5791164 | 11/1980 | Japan . |
| 12680 | 10/1911 | United Kingdom . |
| 1013665 | 12/1965 | United Kingdom . |
| 2117350A | 10/1983 | United Kingdom . |
| 2171077A | 8/1986 | United Kingdom . |
| 2276138A | 9/1994 | United Kingdom . |
| 2283007A | 4/1995 | United Kingdom . |

*Primary Examiner*—Nina Bhat
*Attorney, Agent, or Firm*—Fulbright & Jaworski L.L.P.

[57] ABSTRACT

A boil-in-bag package for the storage and cooking of food items includes an elongated rectangular shaped bag having an inside and an outside wall, a closed top end and an open bottom end. A handle section is adjacent the top end of the bag section, with the handle section having an upper and a lower portion and a first and second side. The upper portion of the handle section includes an opening sized and shaped for receiving a lifting utensil. A sealing/release mechanism is positioned on the handle section and is configured to releaseably close the open bottom end of the elongated bag section contiguous with the handle section thereby forming a U-shaped package configured to allow a through-flow of fluid between the inside walls of the U-shaped package. The sealing/release mechanism is further configured to allow for the release of the open bottom end from the handle section without contacting the elongated bag section.

15 Claims, 8 Drawing Sheets

FIG. 5
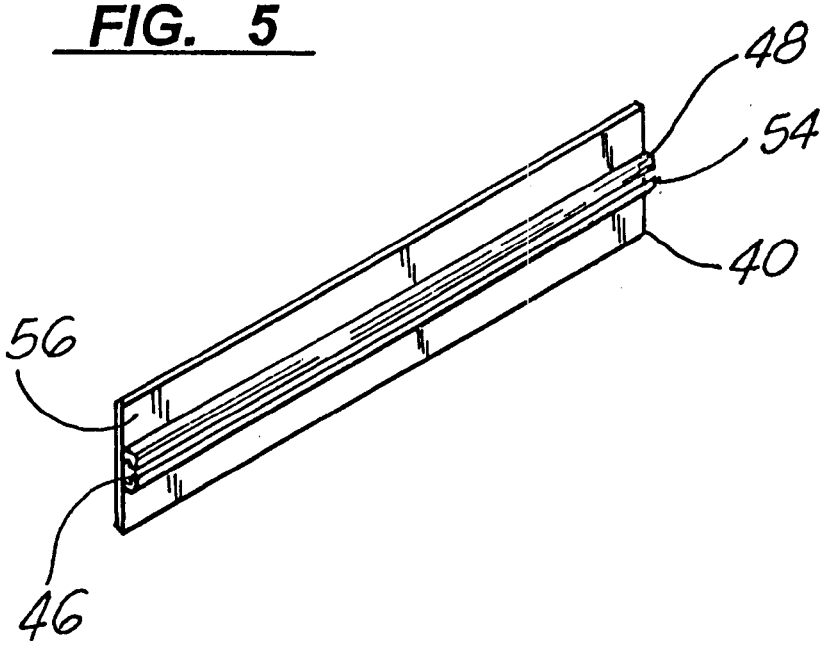
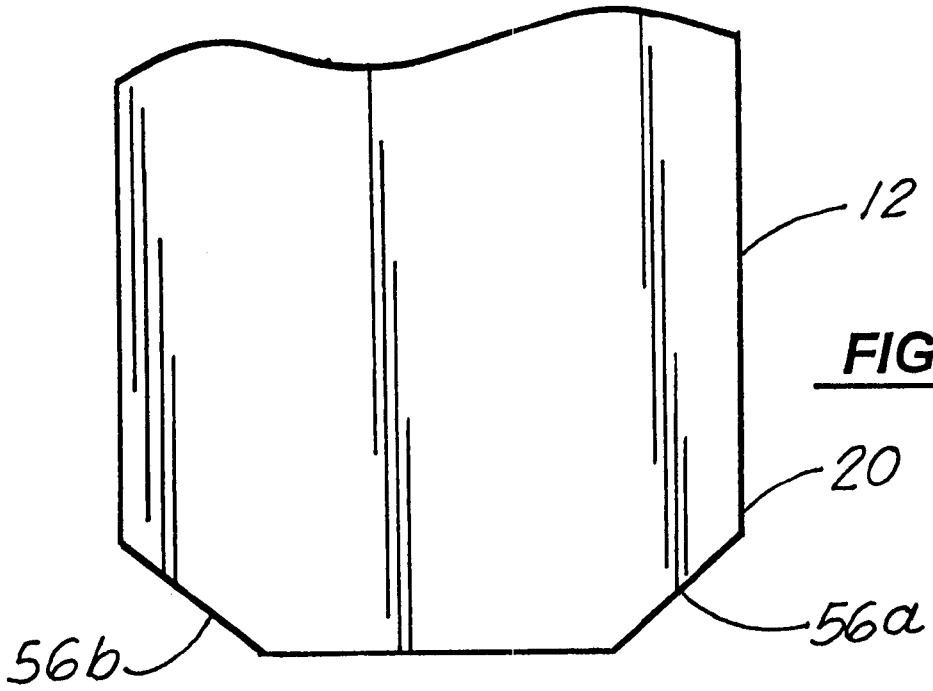
FIG. 6

FIG. 9
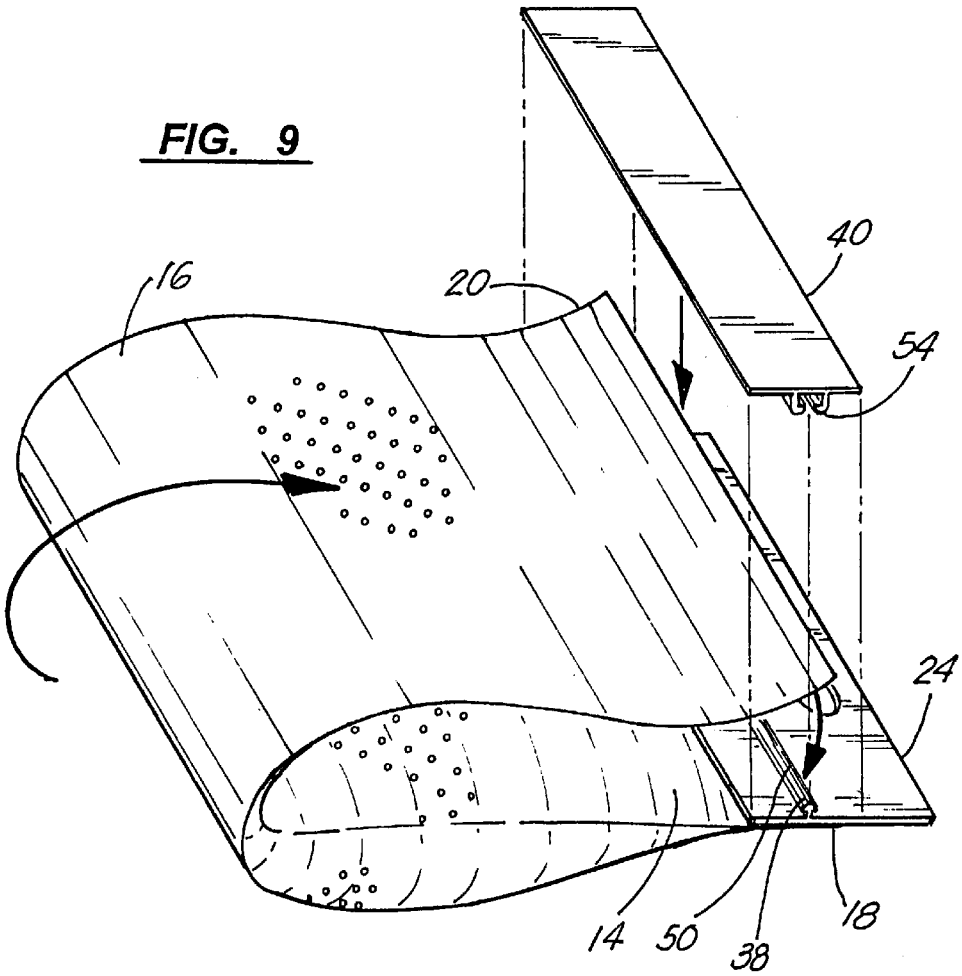
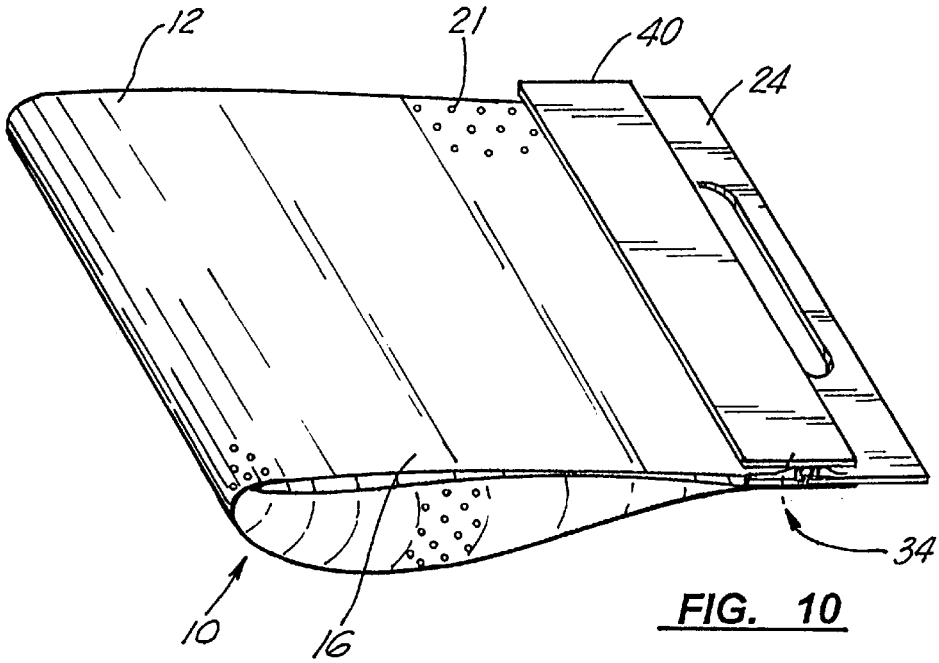
FIG. 10

FIG. 19
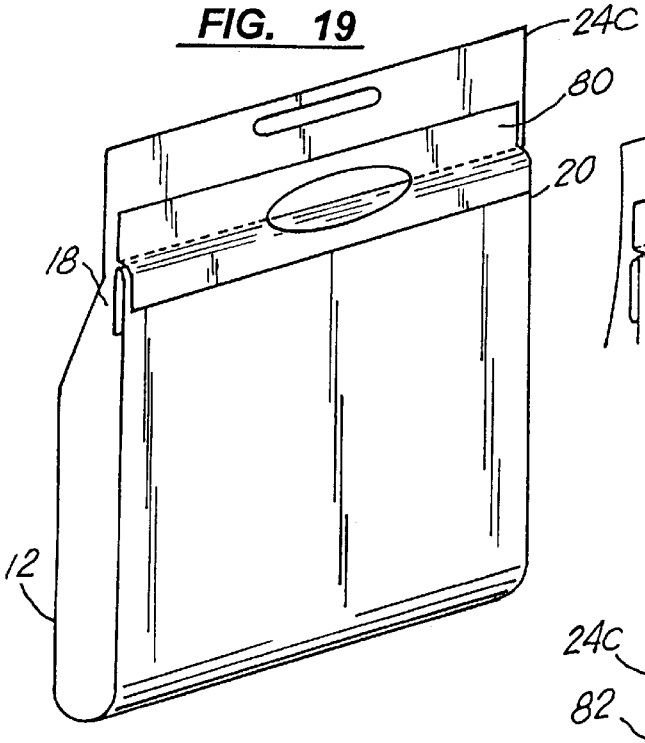
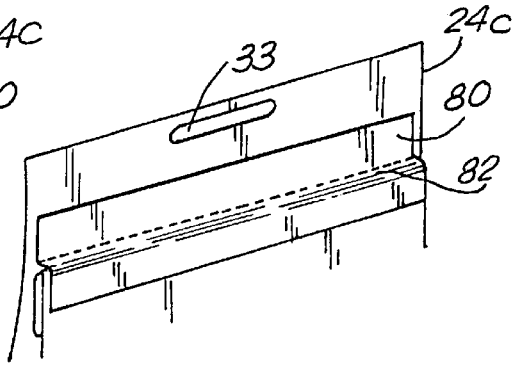
FIG. 20
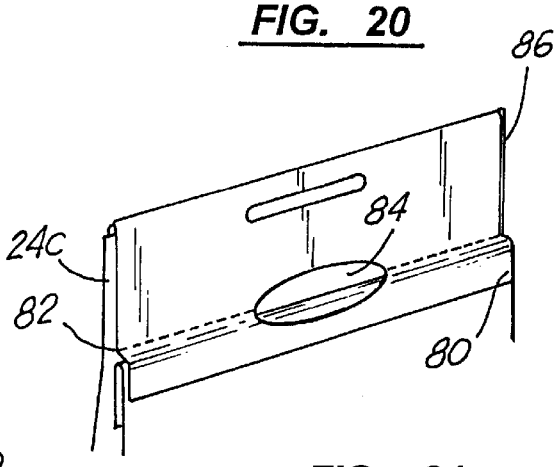
FIG. 21
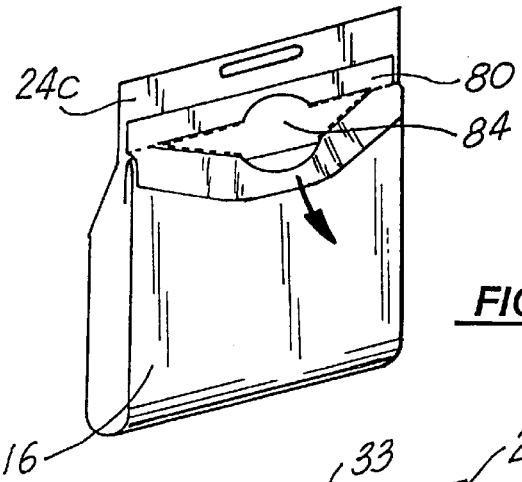
FIG. 22
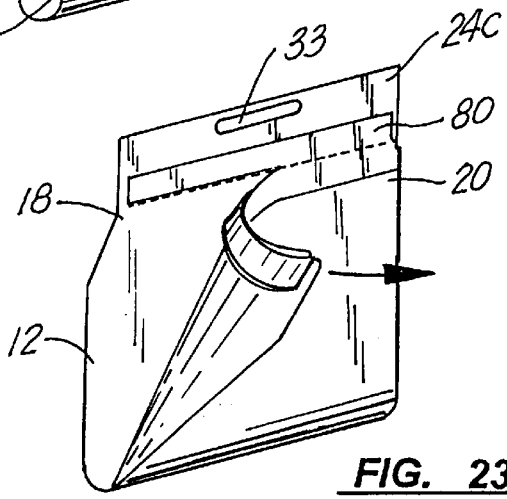
FIG. 23
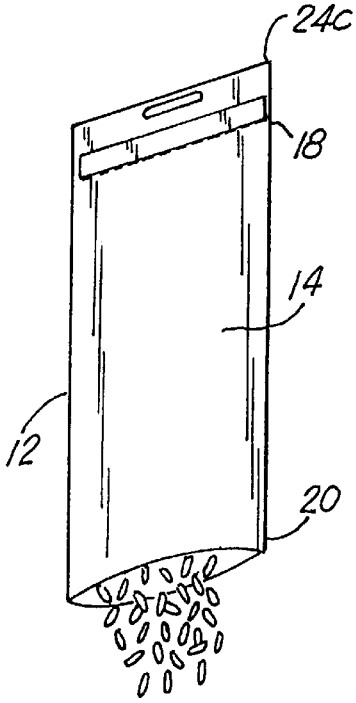
FIG. 24

BOIL-IN-BAG PACKAGE

FIELD OF THE INVENTION

This invention relates to a storage and cooking package for food items and, more particularly, to a specific configuration for a boil-in-bag package that includes a bag with a handle and a sealing and release mechanism for easily dispensing the food item from the package.

BACKGROUND OF THE INVENTION

The use of pouch-type packages or plastic bags for packaging, storing and subsequent cooking or heating of various food items by suspending the bag in boiling water is commonplace. Such a plastic pouch or bag for cooking is described in U.S. Pat. Nos. 3,615,712 and 3,819,089. In practice, the plastic bags are typically formed in a tubular configuration, cut to length and sealed at one end. After being filled with the desired contents, such as rice or other food items, the bags are typically sealed at the remaining open end.

When a consumer is ready to prepare the food item, the bag is immersed in boiling water to cook the food or to heat it to a desired temperature in the case of precooked food. Upon completion of cooking, the bag, with the cooked contents intact, is removed from the boiling water, the bag is then the torn open, and the contents are removed by inverting the bag in order to dump the contents out of the bag. Usually during cooking, the bag has become sufficiently submerged in the boiling water such that no portion of it is conveniently accessible. In removing the bag from the boiling water, the consumer must use a utensil to retrieve the bag while avoiding subjecting his or her hands to the boiling water and the steam given off by the boiling water.

In addition to having to handle a hot bag, the consumer encounters other problems when removing the contents from the bag. The present bags are difficult to open in that they do not tear easily and require cutting with scissors or other sharp implement. This is a difficult and messy task as the bag is a flexible hot object and is not readily openable. Further, actually removing the contents from the bag requires placing the hands and fingers at one end of the hot bag to invert it for dumping out the contents. The above-discussed problems are burdensome and inconvenient and they detract from the intended convenience of using these packaged food products. Additionally, care must be taken in the use of these packaged food products in that it is not easy for the consumer to remove the package from the boiling water and thereafter to extract the contents of the food from the interior of the package without subjecting him or herself to the high temperatures of the boiling water and steam, as well as the hot food and the package itself.

Accordingly, in view of the current boil-in-bag packages there exists a need for a package that allows for the ease of retrieval of the boil-in-bag package from the boiling water, ease of opening the bag and ease of dispensing the food item from the bag.

SUMMARY OF THE INVENTION

The subject invention relates to a boil-in-bag package for the storage and cooking of food items that includes an elongated rectangular shaped bag section having an inside and an outside wall, a closed top end and an open bottom end. A handle section is adjacent the top end of the bag section, with the handle section having an upper and a lower portion and a first and second side. The upper portion of the handle section includes an opening sized and shaped for receiving a lifting utensil. A sealing/release mechanism is positioned on the handle section and is configured to releaseably close the open bottom end of the elongated bag section contiguous with a portion of the handle section thereby forming a U-shaped package that allows for the through-flow of boiling water between the inside walls of the U-shaped package. The sealing/release mechanism is further configured to allow for the release of the open bottom end from the handle section without contacting the elongated bag section. In a preferred embodiment, the sealing/release mechanism is a zipper fastener that is shaped to allow the closing of the open bottom end of the bag section contiguous with the handle section by engaging the inside and outside walls of the open bottom end between interlocking members of the male and female elements of the zipper fastener.

BRIEF DESCRIPTION OF THE DRAWINGS

The invention will become more apparent when the detailed description of exemplary embodiments is considered in conjunction with the appended drawings, in which:

FIG. 5 is a perspective view of the removable female zipper element of the package of FIG. 3;

FIG. 6 is a partial front plan view of an alternate open bottom end of the package of FIG. 3;

FIG. 9 is a perspective view of the embodiment of FIG. 3 illustrating the placement of the bottom end of the bag contiguous with the handle section and the placement of the sealing/release mechanism;

FIG. 10 is a perspective view of the boil-in-bag package of FIG. 10 illustrating a sealed package;

FIG. 19 is a perspective view of an alternate embodiment of the present invention illustrating a handle section with a tape/label sealing/release mechanism;

FIG. 20 is a partial perspective view of one embodiment of the handle section and sealing/release mechanism of FIG. 19;

FIG. 21 is a partial perspective view of a second embodiment of the handle section and sealing/release mechanism of FIG. 19;

FIG. 22 is a perspective view of the handle section and sealing/release mechanism of FIG. 19 illustrating one embodiment of the opening mechanism of the tape/label sealing/release mechanism;

FIG. 23 is a perspective view of the handle section and sealing/release mechanism of FIG. 19 illustrating a second embodiment of the opening mechanism of the tape/label sealing/release mechanism; and FIG. 24 is a perspective view of the embodiment of FIG. 19 illustrating the dispensing of the food item from the boil-in-bag package;

DETAILED DESCRIPTION OF THE PREFERRED EMBODIMENT

Figure 1:
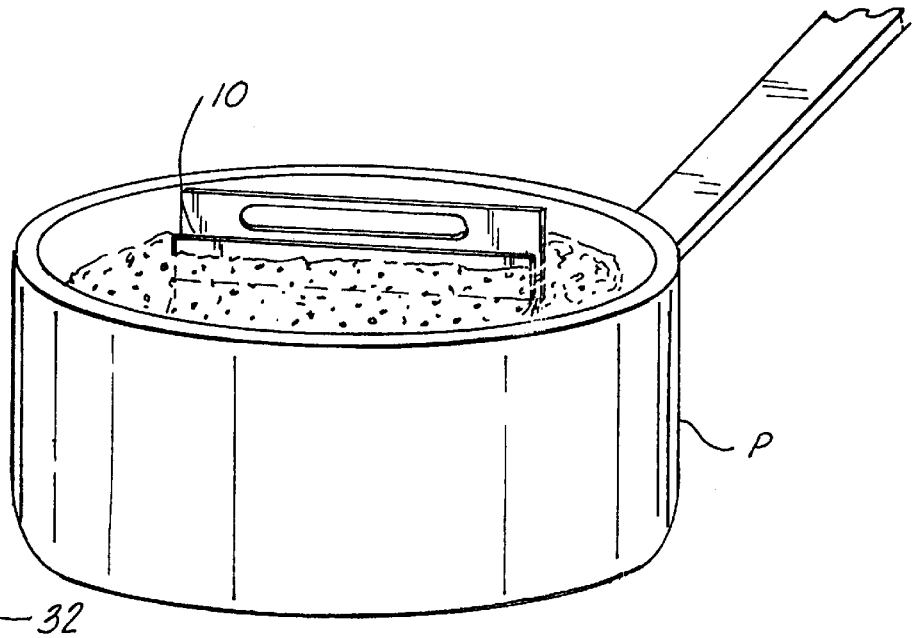
FIG. 1 is a side plan view of the boil-in-bag package of the present invention.

A boil-in-bag package 10 of the subject invention is shown in FIGS. 1–10 of the drawings. The boil-in-bag package 10 has a bag section 12 with an inside wall 14, an outside wall 16, a top end 18 and a bottom end 20. Preferably, bag 12 includes perforations 21 over a significant portion of its surface. The top end 18 is sealed or closed and the bottom end 20 provides an opening 22 into the bag 12 itself A handle section 24 is attached to the sealed top end 18 or is formed as part of the top end 18 of the package 10. Handle section 24 has an upper portion 26, a lower portion 28, a back side 30 and a front side 32. The upper portion 26 includes a slot or oval shaped opening 33 for lifting the bag 12 from the boiling water.

Figure 2:
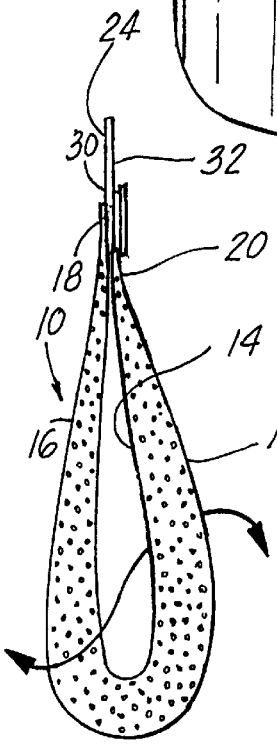
FIG. 2 is a perspective view of the present invention in a container of boiling water.

The handle section 24 includes a sealing/release mechanism 34 that attaches the open, bottom end 20 of the bag 12 to the handle 24, thus forming a U-shaped or folded bag that allows for a through-flow of boiling water between the two inside facing walls 14A of the bag 12. (FIG. 1). When the bag 12 is folded, the food product can be positioned either on both sides of the fold or on one side of the fold. In a preferred embodiment, handle 24 floats in order to provide a means for easy removal of the bag 12 from boiling water in a container P, as illustrated in FIG. 2. The handle section 24 is preferably formed from a material such as polyolefin having a specific gravity less than the specific gravity of water. Handle 24 also provides a place for the sealing/release mechanism 34 that is away from the hot surfaces of the bag 12 and the hot food product. The sealing/release mechanism 34 allows the open bottom end 20 to be released from the handle section 24 without the consumer having to contact the hot bag section 12. The sealing/release mechanism 34 also provides for a convenient way to open the bag 12 without having to use scissors dr other sharp cutting instruments.

Figure 3:
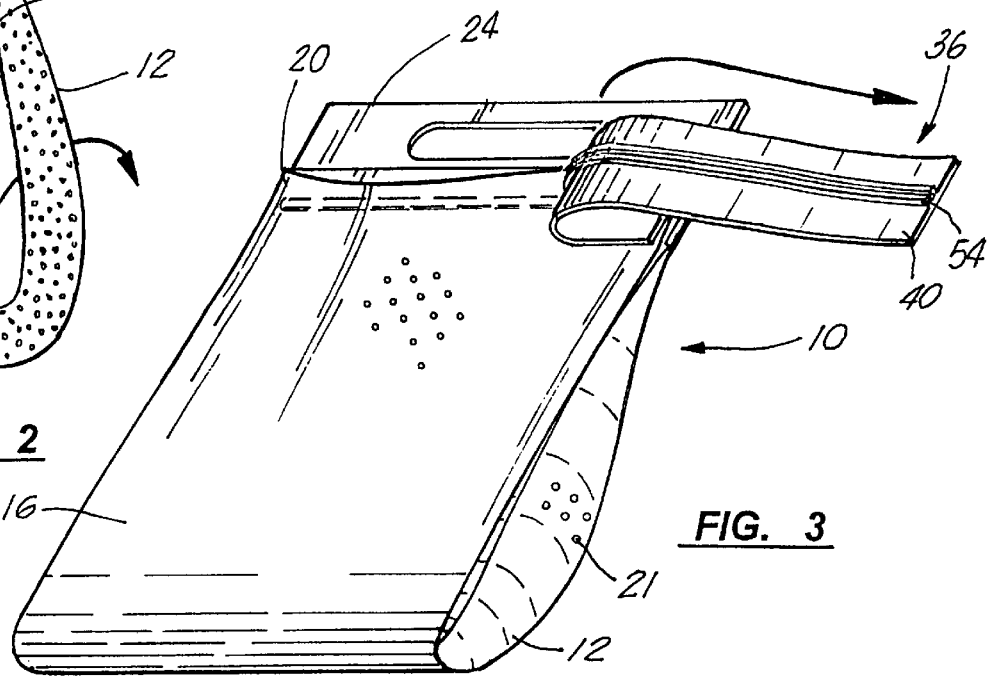
FIG. 3 is a front perspective view of a first embodiment of the boil-in-bag package of the present invention illustrating the disengagement of the sealing/release mechanism.
Figure 4:
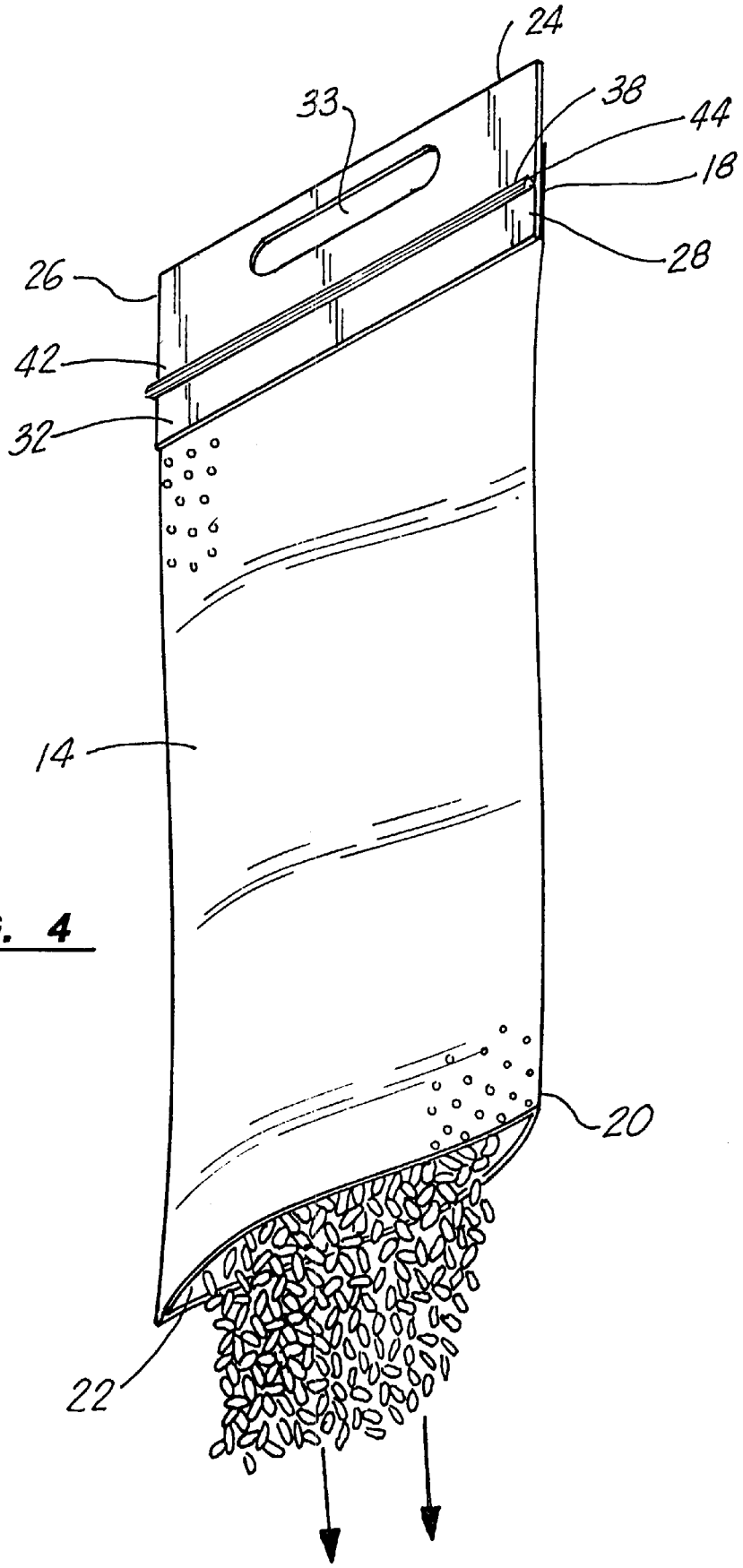
FIG. 4 is a perspective view of the package of FIG.3 illustrating the dispensing of a food item from an open package.

In the preferred embodiment of the invention, the sealing/release mechanism 34 is a zipper fastener 36 attached to handle section 24 in such a manner so as to engage and close the bottom end 20 of bag 12 contiguous with the handle 24 (FIGS. 3–4). Bag 12 is opened by pulling apart a portion of the zipper fastener 36, thus releasing the open bottom end 20 of bag 12 in order to dispense the rice or food product from the bag 12 (FIGS. 3–4). Preferably as shown in FIG. 4, the zipper fastener 36 includes a male strip 38 and a female strip 40. In a preferred embodiment the male strip 38 and handle 24 are extruded or molded as one piece.

Alternatively, the male strip 38 can be attached to the handle 24 by heat sealing or other attachment means known to one skilled in the art. In either embodiment, the male strip 38 is positioned on the lower portion 28 of the front side 32 of handle section 24. Male strip 38 includes a first end 42 and a second end 44. The placement of the male strip 38 is such that it is adjacent the inside wall 14 of bag 12 as shown in FIG. 9. Female strip 40 also has a first and a second end 46 and 48 respectively, and can generally be about half the width of the handle section 24 (FIG. 5). The second end 48 of the female strip 40 can be secured to the handle section 24 adjacent the second end 42 of the male strip 38 by heat sealing or other attachment means known to one skilled in the art, or alternatively it can be unattached and completely removable from the handle section 24. Further, the placement of the male and female strips 38 and 40 can be reversed so that the female strip 40 is on the handle portion 24 and the male strip 38 is the removable strip.

Figure 7:
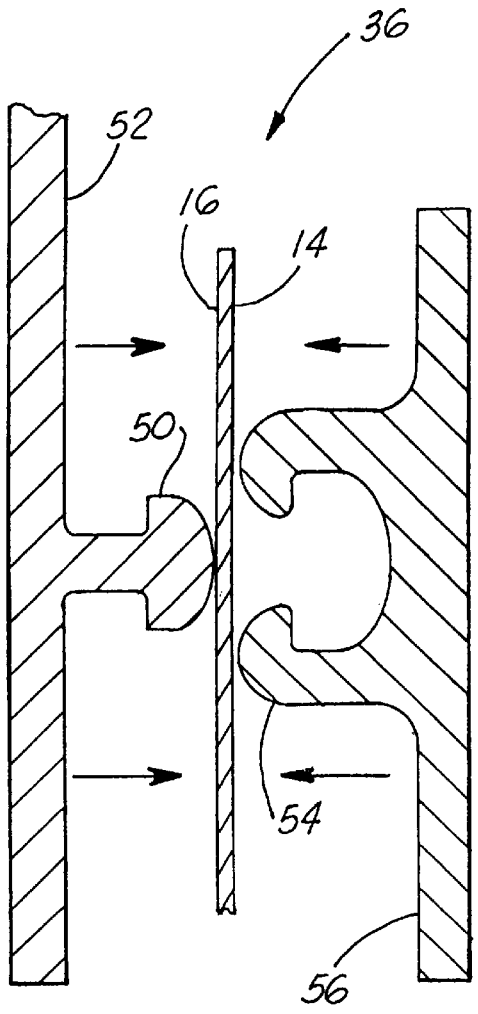
FIG. 7 is a partial cross sectional view of the disengaged male and female zipper elements of the sealing/release mechanism of FIG. 3.
Figure 8:
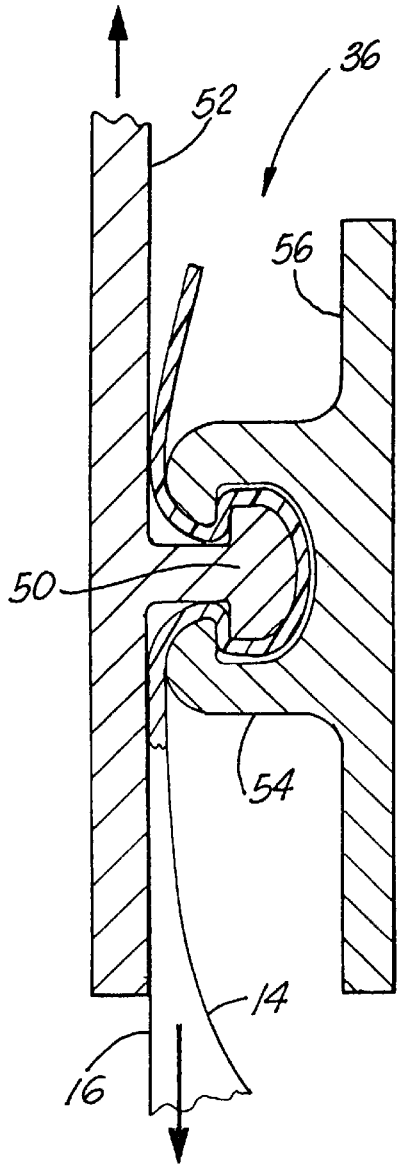
FIG. 8 is a partial cross sectional view of the engaged male and female zipper elements of the sealing/release mechanism of FIG. 3 illustrating the interposition of the walls of the bottom end of the bag.

The zipper fastener 36 is constructed and arranged for selected interlocking. The interlocking members of the zipper fastener 36 can be of any known configuration in the art of zipper fasteners. An example of a zipper fastener is illustrated in FIGS. 7 and 8 in which the male strip 38 has a generally cylindrical member 50 perpendicularly attached to a flat base 52 and the female strip 40 has a substantially C-shaped member 54 perpendicularly attached to a flat base 56. C-shaped member 54 is sized and shaped for reception of and engagement with cylindrical member 52. There is a sufficient gap between members 52 and 54, when engaged, to allow the two layers of the inside and outside walls 14, 16 of the bottom end 20 of bag 12 to be interposed therebetween. As a result, the two strips 38, 40 can be inter-engaged with each other through the inside and outside walls 14, 16 of the bag 12 as illustrated in FIGS. 9 and 10.

The open bottom end 20 of bag 12 can be the same width as the zipper fastener 36 if the female strip 40 is not attached through heat sealing to the handle section 24 (FIGS. 9 and 10). As shown in FIG. 3, when releasing the contents of the bag 12, the consumer peels off the female strip 40 and discards it. Alternatively, when the female strip 40 is heat sealed to the handle section 24, a chamfer or beveled cut 56 can be made at either one or both sides of the open bottom end 20 of bag 12 (FIG. 6). These cutouts 56 are positioned in a plane adjacent to the zipper fastener 36. A first chamfer cut 56*a* allows for the second end 48 of the female strip 40 to be heat welded to the handle section 24 and a second chamfer cut 56*b* allows for the consumer to grasp the first end 46 of the female strip 40, without pinching the bag 12, in order to pull the zipper fastener 36 apart. Bag 12 preferably has a zipper fastener 36 sized from a range of generally about 4.5 to 6 inches and a bag length from a range of generally about 10.5 to 14 inches. However, other dimensions of zipper fasteners 36 and bag lengths are contemplated.

Bag 12 can be formed from any heat-sealable plastic film known to one skilled in the art. An example of heat-sealable plastics are polyolefins and nylons. Preferably this plastic film has a thickness of 0.25 to 5 mil, with a preferred range of 0.5 to 3 mil and most preferably a range of 1.25 to 2 mil. Zipper fastener 36 can be formed from any suitable polymeric material known to those skilled in the art. In a preferred embodiment, zipper fastener 36 is formed from polypropylene. While the zipper fastener 36 is a preferred embodiment of the sealing/release mechanism 34 of the present invention, any number of sealing/release mechanisms can be used to releaseably close the bottom open end 20 of bag 12 contiguous to the handle portion 24. The following is just a description of a few examples of some of the sealing/release mechanisms that are contemplated. Those skilled in the art will recognize that other mechanisms, such as snaps or other fasteners, clips, adhesives, twist-ties, or peelable heat seals, can be used to accomplish the desired sealing/release mechanism 34 of the subject invention.

Figure 11:
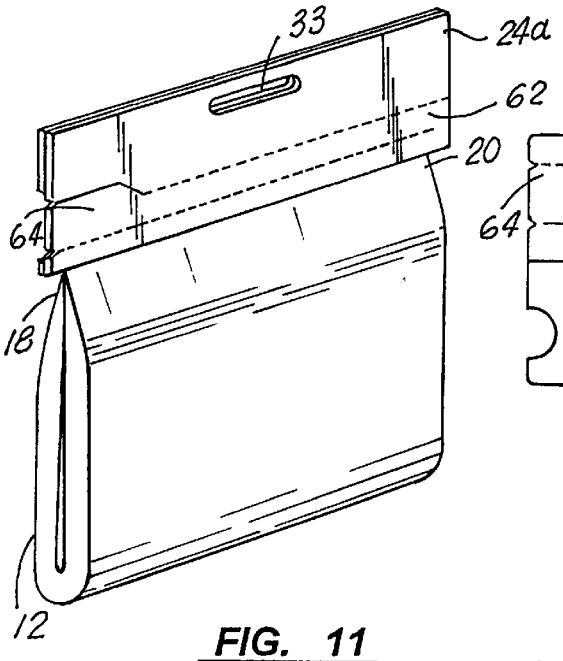
FIG. 11 is a perspective view of an alternate embodiment of the present invention illustrating a handle section with a tear strip sealing/release mechanism.
Figure 12:
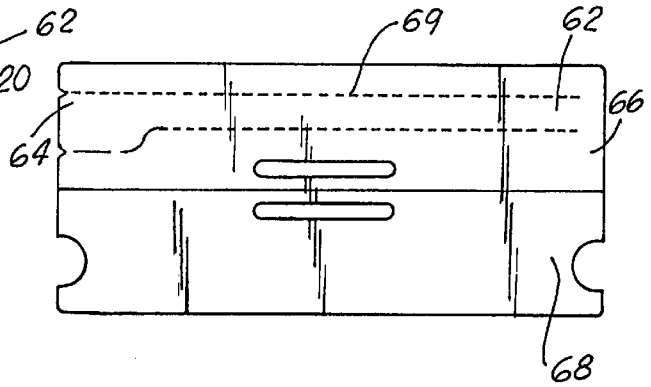
FIG. 12 is an outside plan view of the handle section and sealing/release mechanism of FIG. 11.
Figure 13:
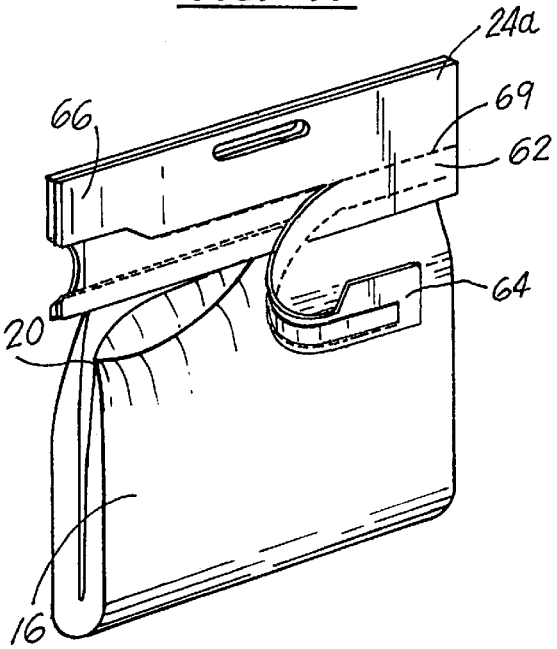
FIG. 13 is a perspective view of the handle section and sealing/release mechanism of FIG. 11 illustrating the opening mechanism of the tear strip sealing/release mechanism.
Figure 14:
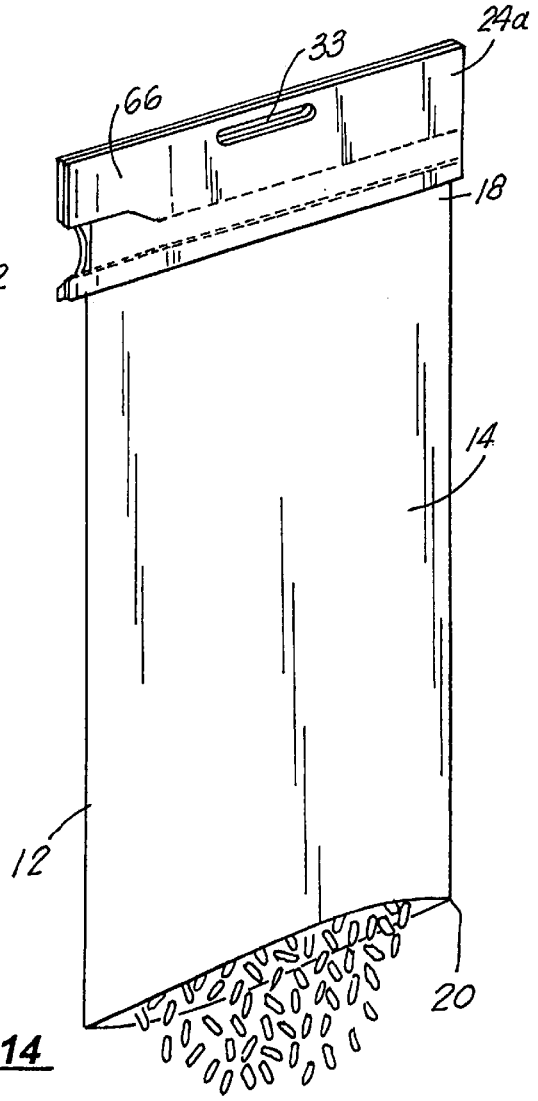
FIG. 14 is a perspective view of the embodiment of FIG. 11 illustrating the dispensing of the food item from the boil-in-bag package.

One example of another sealing/release mechanism 34 is a plastic tear strip mechanism 60 as shown in FIGS. 11–14. In this example, a handle 24*a* includes a tear strip 62 having a pull tab end 64. The handle 24*a* is wider than bag 12 by at least a quarter inch on each side to allow room to grasp the end 64 of tear strip 62 and to allow tear strip 62 to extend past the edge of bag 12 when it is opened. As shown in FIG. 12, handle 24*a* includes a front side 66 and a back side 68, with the tear strip 62 being positioned on the front side 66 of handle 24*a*. Tear strip 62 is perforated so that upon pulling, the perforation 69 is broken, releasing the open bottom end 20 of bag 12 (FIGS. 13–14). The construction of the bag 12 is such that the top and bottom ends 18, 20 of bag 12 are placed between the front and back sides 66, 68 of handle 24*a* (FIG. 11). The bottom end 20 includes a perforation (not shown) that matches the perforation 69 of tear strip 62. Thus, as shown in FIGS. 13 and 14, when tear strip 62 is pulled away from the handle 24*a*,it breaks the perforation 69 on both the tear strip 62 and bottom end 20 of bag 12 to release the bottom end 20 from handle 24*a* in order to dispense the food contents from bag 12. Handle 24*a* and tear strip 62 can be formed from any suitable polymer such as a polypropylene. Handle 24*a* also includes the slot 33 for lifting the bag 12 from the boiling water.

Figure 15:
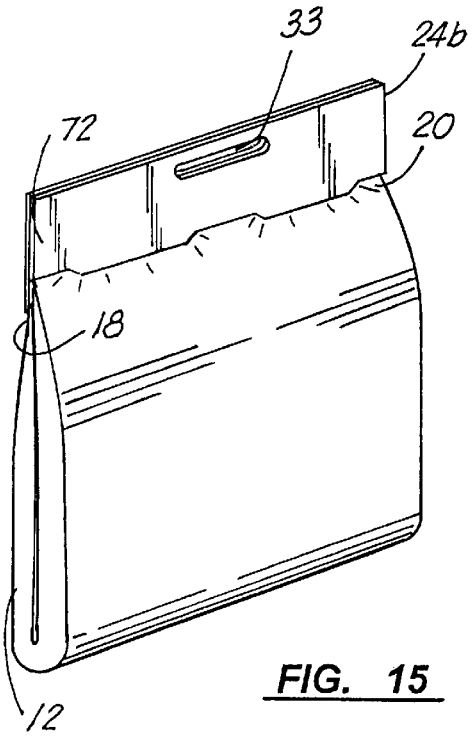
FIG. 15 is a perspective view of an alternate embodiment of the present invention illustrating a handle section with a tuck tab sealing/release mechanism.
Figure 16:
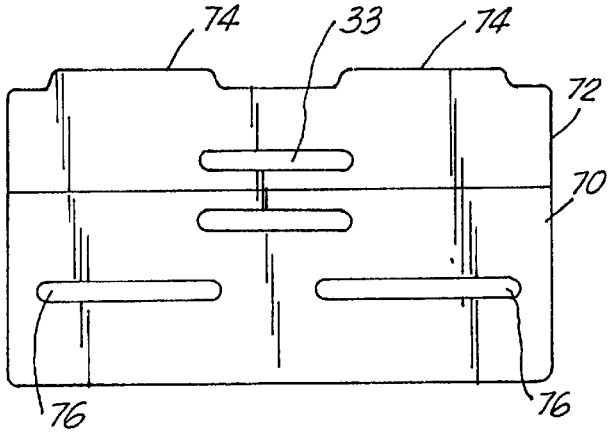
FIG. 16 is an outside plan view of the handle section and sealing/release mechanism of FIG. 15.
Figure 17:
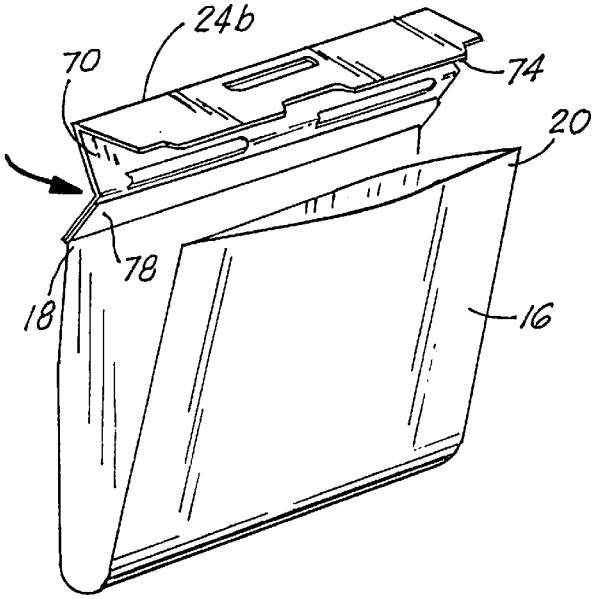
FIG. 17 is a perspective view of the handle section and sealing/release mechanism of FIG. 15 illustrating the opening mechanism of the tuck tab sealing/release mechanism.
Figure 18:
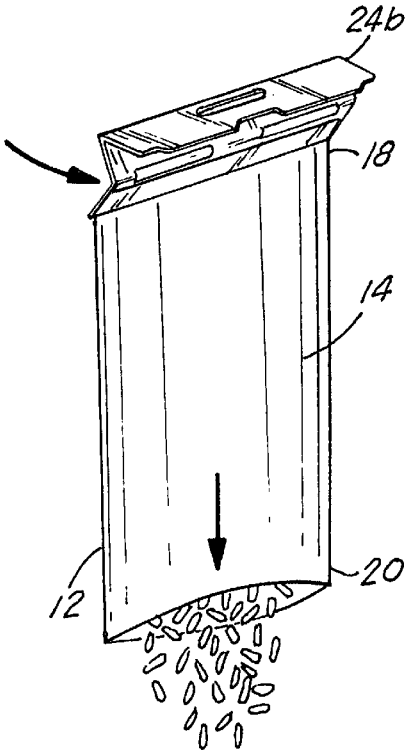
FIG. 18 is a perspective view of the embodiment of FIG. 15 illustrating the dispensing of the food item from the boil-in-bag package.

FIGS. 15–18 illustrate another example of a sealing/release mechanism 34 that includes a handle 24*b* with tuck tabs along its top edge configured to hold in place the open bottom end 20 of bag 12. Handle 24*b* is generally rectangular in shape and has a back side 70, and preferably, a fold-over front side 72. Front side 72 includes, at least one and preferably, two or more tabs 74 and back side 70 includes, at least one and preferably, two or more slots 76 in parallel alignment with tabs 74 (FIG. 16). Tabs 74 engage slots 76 to impinge the open bottom end 20 of bag 12. The top end 18 of bag 12 is secured to the outside or inside edge 78 of the back side 70 of handle 24*b*. The bottom end 20 is layered between the slots 76 and tabs 74 which allow the tabs 74 to tuck into slots 76 through the two layers of bag film to seal the open bottom end 20 of bag 12 (FIG. 15). To open the bag 12, handle 24*b* is bent back to disengage the tabs 74 and release the open end 20 of bag 12 (FIG. 17). Handle 24*b* with the tuck tab mechanism can have the same width as bag 12 or it may be slightly narrower than bag 12. Handle 24*b* can be formed from any suitable polymeric material. Handle 24*b* also includes the slot 33 for lifting the bag 12 from the boiling water.

A third example of a sealing/release mechanism 34 is shown in FIGS. 19–24, in which a tape or a label is used to secure the open bottom end 20 of bag 12 to a handle 24*c* without permanently heat-sealing the bottom end 20. A pressure sensitive tape or label 80 is applied to a folded-over bottom end 20 of bag 12 that is positioned on a lower portion 28 of handle section 24 (FIG. 19). The tape/label 80 extends beyond the folded bottom end 20 of bag 12 in order to adhere the bottom end 20 of bag 12 to the handle section 24*c*. Alternatively, handle section 24*c* can be an extension of the bag end 18. As shown in FIGS. 19–21, tape/label 80 includes a perforation 82 adjacent to the folded edges of the open bottom end 20 that allows the consumer to easily tear away the tape/label 80 in order to release the bottom end 20 from the handle 24*c*. The tape/label 80 can include an opening 84 in the center portion of the tape/label 80 to assist the consumer in pulling the tape/label 80 away from the handle 24*c* in order to break the perforations 82 (FIG. 21). The tape/label 80 can be in the shape of a strip (FIG. 20) or it can include a header 86 that covers the upper portion 26 of handle 24*c* (FIG. 21). Alternatively, as illustrated in FIG. 23, a corner of the top end of the bag 12 can be pulled outwardly in order to break the perforation 82 and tear across the bottom end 20 of bag 12. Handle 24*c* also includes the slot 33 for lifting the bag 12 from the boiling water. In this example the bag material is the same as described above. The tape/label 80 is formed from material such as pressure sensitive tapes or labels, and a preferred material for cooking use is an acrylic adhesive with polypropylene backing.

A process for forming the boil-in bag packages 10 can generally be described as follows. Film stock that is either pre-perforated or perforated on line is used to construct the boil-in-bag packages. Continuous rolls of plastic film of a material described above, are V-folded and the sides of individual packages on the continuous ribbon are sealed. If desired one or both of the corners of the bottom ends 20 can be beveled. Each package is then opened and filled with a food product such as rice. The handle sections 24 are attached to the top ends 18 of the packages 10, or alternatively a handle section can be formed from a section of the top end 18 of the package 10. The packages are then folded to form the U-shape of the packages 10. The zipper fasteners 36 are attached to the packages 10 in a way that allows the walls of the open bottom end 20 to be interposed between the zipper fasteners 36, thus closing the open bottom end 20 of each package 10. The continuous ribbon is then cut through the side seals and zipper fasteners to separate the multiple packages.

Although the present invention has been described with reference to its preferred embodiments, those skilled in the art will recognize changes which may be made in form and structure which do not depart from the spirit of the invention already described in the specification and embodied in the claims which follow.

What is claimed is:

1. A boil-in-bag package for the storage and cooking of food items, the package comprising:

a) an elongated rectangular shaped bag section having an inside and an outside wall, a closed top end and an open bottom end;

b) a handle section adjacent the top end, said handle section having an upper and a lower portion, and a first and second side, said upper portion including an opening sized and shaped for receiving a lifting utensil;

c) a sealing/release mechanism positioned on the handle section and configured to releaseably close the open bottom end of said elongated bag section contiguous with a portion of the handle section by capturing the open bottom end within the sealing/release mechanism, thereby forming a U-shaped package configured to allow a through-flow of fluid between the inside walls of the U-shaped package, and d) the sealing/release mechanism being further configured to allow for the release of the open bottom end from the handle section without contacting the elongated bag section.

2. The boil-in-bag package of claim 1, wherein the handle section is separately formed and attached to the top end of the bag section.

3. The boil-in-bag of claim 1, wherein the handle section is formed of a material having a specific gravity less than the specific gravity of water.

4. The boil-in-bag package of claim 1, wherein the sealing/release mechanism is a zipper fastener having first and second elements configured for selective interlocking, the elements having first and second ends and interlocking members.

5. The boil-in-bag package of claim 4, wherein one of the elements of the zipper fastener is longitudinally attached to the lower portion of the second side of said handle section.

6. The boil-in-bag package of claim 4, wherein a portion of the second end of the second element of the zipper fastener is attached to the handle section adjacent the second end of the first element.

7. The boil-in-bag package of claim 4, wherein the zipper fastener closes the open bottom end of the bag section contiguous with the handle section by engaging the inside and outside walls of the open bottom end between the interlocking members of the first and second elements.

8. The boil-in-bag package of claim 7, wherein the bottom end of the bag section is released from the handle section by disengaging the interlocking member of the second element from the interlocking member of the first element.

9. The boil-in-bag package of claim 1, wherein the bag section is formed from a heat sealable plastic film material.

10. The boil-in-bag package of claim 8, wherein the bag section material has a thickness in a range of generally about between 0.25 to 5.0 mil.

11. The boil-in-bag package of claim 10, wherein the bag section material has a thickness in a range of generally about of 0.5 to 3.0 mil.

12. The boil-in-bag package of claim 1, wherein the sealing/release mechanism is a perforated tear strip contained within the handle section, the tear strip releasing the open bottom end of the bag section from the handle section when the perforations of the tear strip are broken.

13. The boil-in-bag package of claim 1, wherein the sealing/release mechanism is formed from a handle section having at least one tab and at least one slot in parallel alignment with the at least one tab, the handle section being configured to hold and release the open bottom end of the bag section contiguous with the handle section.

14. The boil-in-bag package of claim 1, wherein the sealing/release mechanism is an elongated pressure sensitive tape having a perforated line, said tape being applied to and extending beyond a folded open end of the bag section positioned contiguous to the handle section, the tape releasing the folded open bottom end of the bag section form the handle section when the perforations of the tape are broken.

15. A boil-in-bag package for the storage and cooking of food items, the package comprising:

a) an elongated rectangular shaped bag section having an inside and an outside wall, a closed top end and an open bottom end;

b) a handle section adjacent the top end, said handle section having an upper and a lower portion, and a first and second side, said upper portion including an opening sized and shaped for receiving a lifting utensil;

c) a zipper fastener positioned on the handle section and configured to releaseably close the open bottom end of said elongated bag section contiguous with a portion of the handle section thereby forming a U-shaped package configured to allow a through-flow of fluid between the inside walls of the U-shaped package;

d) the zipper fastener having first and second elements with interlocking members, the first element being longitudinally attached to the handle section, the first and second elements engaging the inside and outside walls of the open bottom end between their respective interlocking members to close the open bottom end; and e) the zipper fastener being further configured to allow for the release of the open bottom end from the handle section without contacting the elongated bag section.

* * * * *